United States Patent [19]

Haldipur

[11] Patent Number: 4,569,681

[45] Date of Patent: Feb. 11, 1986

[54] FLUIDIZATION AND SOLIDS RECIRCULATION PROCESS FOR A FLUIDIZED BED GASIFIER

[75] Inventor: Gaurang B. Haldipur, Greensburg, Pa.

[73] Assignee: KRW Energy Systems Inc., Madison, Pa.

[21] Appl. No.: 588,421

[22] Filed: Mar. 12, 1984

[51] Int. Cl.[4] ..... C10J 3/54

[52] U.S. Cl. ..... 48/206; 48/DIG. 4

[58] Field of Search ..... 48/197 R, 202, 206, 48/210, 77, 86 A, DIG. 4

[56] References Cited

U.S. PATENT DOCUMENTS 3,981,690 9/1976 Chen et al. ..... 48/206

4,282,010 8/1981 Cherish et al. ..... 48/77

*Primary Examiner*—Peter Kratz

[57] ABSTRACT

A fluidized bed gasifier and a method for operating for the gasification of carbonaceous material comprising a vertically disposed elongated vessel comprising an upper section of a first diameter, a lower section of a second diameter and a transition section disposed therebetween wherein the first diameter is greater than the second diameter; a tubular manifold disposed generally horizontally and within the vessel; gas supply means penetrating said vessel and fluidly connected with said manifold and a plurality of tubes each having an inlet and an outlet, said inlet attached to, in fluid communication with, and distributed about the manifold and said outlets directed downwardly towards the interior of the vessel adjacent the transition section.

1 Claim, 8 Drawing Figures

FLUIDIZATION AND SOLIDS RECIRCULATION PROCESS FOR A FLUIDIZED BED GASIFIER

BACKGROUND OF THE INVENTION

1. Field of the Invention

This invention relates to gasification of carbonaceous materials and more particularly to a method for separation and cooling of ash from fluidized bed gasifiers.

2. Description of the Prior Art

In reactors for the gasification of carbonaceous materials, such as coal, a combustible product gas is produced as well as solid waste products such as agglomerated ash. In a typical fluidized bed gasifier, coal particles are pneumatically transported by a gas into the hot gasifier. Process mediums such as steam, coal in particle form, and a gaseous source of oxygen, such as air or pure oxygen, as well as, perhaps, a clean recycled product gas are injected through a nozzle. This process results in fluidization of the coal particles in a bed above the nozzle. Further, the injection of coal and oxygen into the hot gasifier results in combustion of a portion of the coal, and the heat thereby released maintains the temperature in the gasifier. As the noncombusted coal particles are heated, rapid evaporation of volatiles in the coal, called devolatilization, occurs. The average temperature within the vessel typically runs between 1600° F. and 2000° F. or higher and this high temperature ensures that the products of devolatilization, such as tars and oils, etc., are broken down, or cracked, and gasified to form methane, carbon monoxide and hydrogen. As the coal continues to heat, devolatilization is completed and particles of coal become pieces predominantly of ungasified carbon, or char. As this char circulates throughout the fluidized bed, the carbon in the char is gradually consumed by combustion and gasification, leaving particles that have a high ash content. These ash-rich particles contain mineral compounds and eutectics that melt at temperatures of between 1000° F. to 2000° F. and typically consist of compounds of any or all of S, Fe, Na, Al, K and Si, which compounds are typically denser than carbon compounds. These liquid compounds within the particles extrude through pores to the surfaces where they cause the particles to stick to each other, or agglomerate. In this way, ash agglomerates are formed that are larger and denser than the particles of char in the bed. As their density and size increases, the fluidized bed is unable to support them, and the ash agglomerates defluidize. It is then necessary to remove these ash agglomerates from the vessel.

This process of combustion, gasification and ash agglomeration is not a particularly rapid or complete process. Typically, coal particles pneumatically injected into the gasification vessel are traveling at a fairly significant velocity at the nozzle outlet. These particles may travel quickly through a combustion flame and be only partially combusted and gasified prior to melting of the mineral compounds and eutectics. As a consequence, it is desirable to recirculate these particles back through the zone in which combustion is taking place.

One method of recirculation may be to entrain and discharge all the particles with the product gas, separate the product gas from the particles in a device external to the gasifier vessel, then recirculate these particles back into the vessel. This is not a particularly efficient method of recirculation.

A more efficient means of recirculation would be an internal recirculation means which would result in recirculation of the particles back through the combustion zone without leaving the gasifier vessel. One embodiment of this means involves distributing a gas into the gasification vessel by means of a refractory brick assembly having gas distribution outlets. This design is inadequate for several reasons. The gas may bypass the gas distribution outlets through micro-cracks and fissures in the refractory brick causing non-uniform distribution. The nature of refractory brick makes the steam distribution outlets difficult to fabricate and properly size, which may cause solids to back-flow into the outlets. Further, the mere introduction of a gas into the periphery of the vessel does not necessarily result in any solid recirculation.

What is needed is an internally contained, plug resistant, solids recirculation apparatus and method which will promote solids recirculation within a fluidized bed gasifier in a uniform pattern, and which will be easily fabricated and installed.

It is also desirable to provide an ash separation means which will allow cooling of the ash prior to withdrawal to minimize fouling of internal gasifier surfaces. It is further desirable to accomplish the above in a manner which discourages perturbations in the dynamics of the fluidized bed.

SUMMARY OF THE INVENTION

Disclosed is a fluidized bed gasifier and a method for operating for the gasification of carbonaceous material comprising a vertically disposed elongated vessel comprising an upper section of a first diameter, a lower section of a second diameter and a transition section disposed therebetween wherein the first diameter is greater than the second diameter; a tubular manifold disposed generally horizontally and within the vessel; gas supply means penetrating said vessel and fluidly connected with said manifold and a plurality of tubes each having an inlet and an outlet, said inlet attached to, in fluid communication with, and distributed about the manifold and said outlets directed downwardly towards the interior of the vessel adjacent the transition section.

BRIEF DESCRIPTION OF THE DRAWINGS

The advantages, nature and additional features of the invention will become more apparent from the following description taken in connection with the accompanying drawings in which.

DESCRIPTION OF THE PREFERRED EMBODIMENTS

Figure 1:
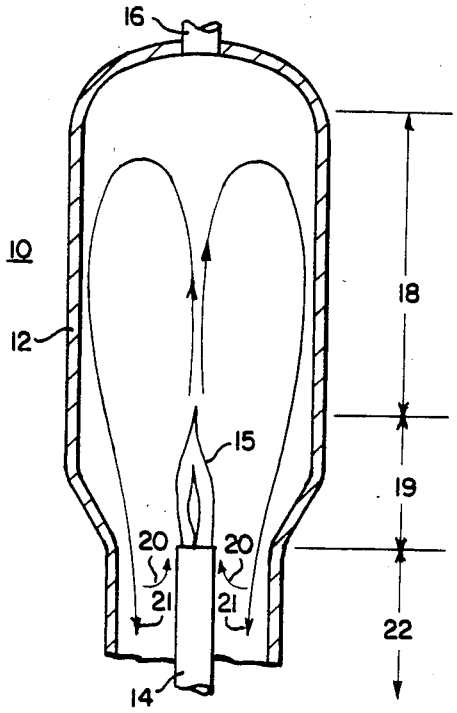
FIG. 1 is an elevational sectional view of a fluidized bed gasification system.

Referring now to FIG. 1 there is shown a fluidized bed gasifier 10 comprising a generally elongated vessel 12, the bottom of which is penetrated by a nozzle 14, which extends upwardly into the vessel 12. Penetrating the top of the vessel 12 is a product gas outlet 16. The vessel 12 has three major horizontal regions: (1) the bed region 18 in the uppermost portion of the vessel 12 and extending downwardly to approximately the top of the combustion flame 15 formed at the top of the nozzle 14; (2) the combustor region 19 below the bed region 18 and above the top of the nozzle 14; and (3) the annulus region 22 extending from the top of the nozzle 14 downward. There is also shown the char particles flow pattern 20 and the agglomerated ash flow pattern 21. It can be seen that particles flow upwardly from the nozzle 14, through the flame 15, circulate into and through the bed region 18, downwardly through the combustor region 19 and into the annulus region 22. In the annulus region 22, the char and ash are separated, char recirculating upward, and ash defluidizing downward.

Figure 2:
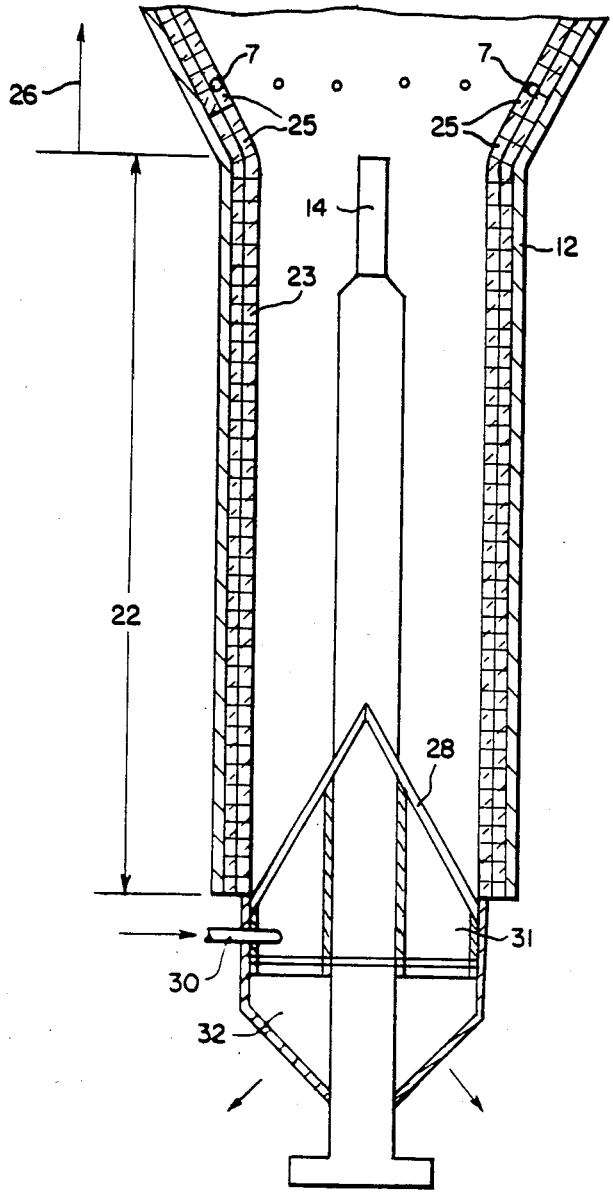
FIG. 2. PRIOR ART
FIG. 2 is an elevational sectional view of the annulus section of a gasification system showing a gas injection cavity in accordance with the state of the art.

Referring now to FIG. 2, there can be seen the annulus region 22 of the vessel 12. The vessel 12 may be internally lined with a heat resistant insulating material 23, such as refractory ceramic. A cavity 7, in accordance with the state of the art, is located at a position which is above the elevation of the top of the nozzle 14 in a vessel diameter transition section 26. The cavity 7 is formed by the placement of specially manufactured refractory brick 25. These bricks 25 may comprise an indented region which when matched to a like formed brick 25 forms a ring-shaped cavity circling the transition section 26. Because of the nature of refractory ceramic brick 25, it is difficult, bordering on the impossible, to make this cavity 7 gas-tight. As a result, any gas introduced into this cavity 7 from outside of the vessel 12 will leak in a random pattern into the vessel 12.

A floor 28 may be situated at the bottom of the annulus 22. A gas, typically clean recycled product gas, is injected through inlet 30 into a floor gas plenum 31 beneath the floor 28. Beneath the floor gas plenum 31 is an ash plenum 32.

Figure 3:
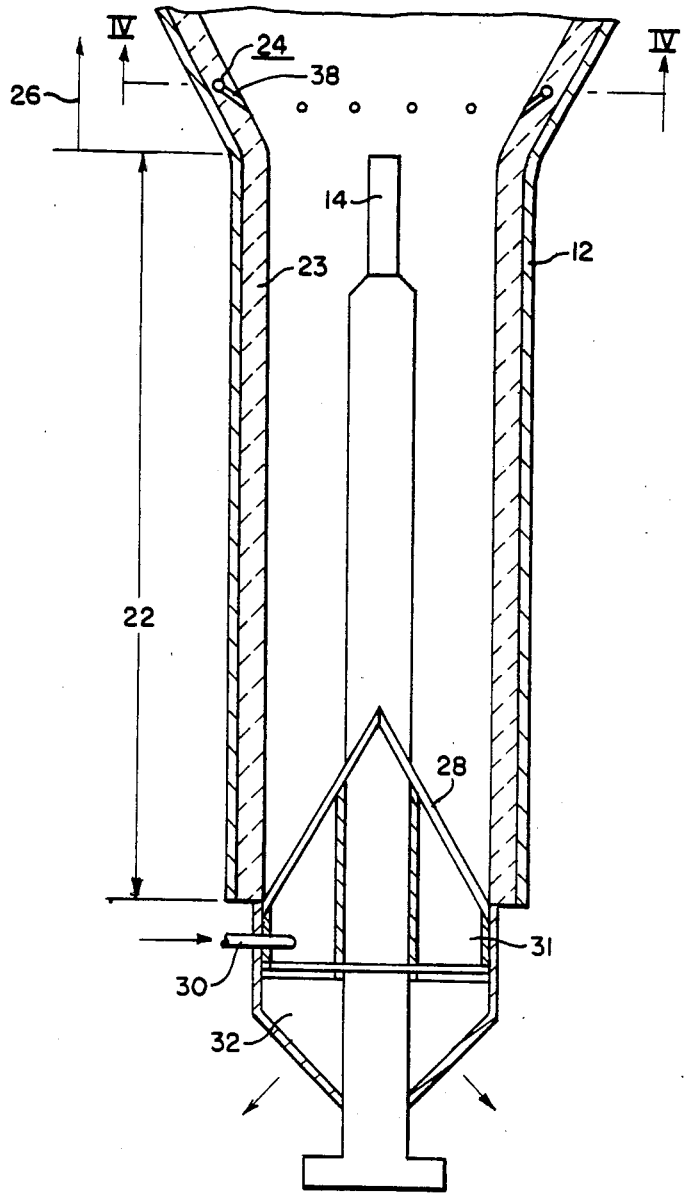
FIG. 3 is an elevational sectional view of the annulus section of a gasification system showing a gas injection grid in accordance with the invention.

In contrast, looking at FIG. 3, there can now be seen a gas injection grid 24 in accordance with the invention. This grid 24 will typically be manufactured of metal and should be leak-tight except for those points where gas injection into the vessel 12 is specifically desired. The transition section 26 is generally a steep slope. Ideally, it should be steep enough to overcome the internal friction of the defluidizing particles. This angle will preferably have a slope of between 65° and 75° from the horizontal and dry particles of defluidizing char and ash will continue to roll down the transition section without piling up.

Figure 4:
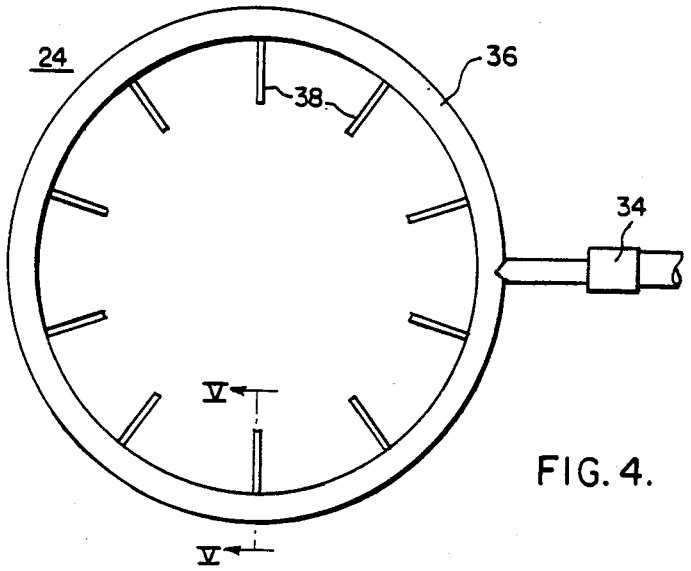
FIG. 4 is a plan view of the gas injection grid taken from IV—IV of FIG. 3.

FIG. 4, taken from FIG. 3 at IV—IV, shows a plan view of the grid 24. A grid gas supply 34 penetrates the vessel 12 passing through the refractory ceramic 23 and is attached flowingly to a grid manifold 36. The grid manifold 36 may either be imbedded in the ceramic or attached to the vessel 12. In either case, in encircles the annulus region 22 of the vessel 12. Spaced around the grid manifold 36 and flowingly attached to it are a series of grid tubes 38. In operation a grid gas, which may be either steam or clean recycled product gas, flows through the grid gas supply 34 into the grid manifold 36 and into the annulus region 22 of the vessel 12 through the grid tubes 38.

The grid tubes 38 are disposed downwardly from the horizontal into the vessel 12 preferably toward the top of the nozzle 14. This downward angle should be such that the angle between the centerline of the injected gas stream and the slope of the transition section 26 is greater than 7° to prevent steam cutting of the transition section 26 by the expanding cone of the injected gas stream. One particular advantage of this invention over the prior art is that whereas the prior art simply injected a gas into a region adjacent the transition section 26, the invention directs the gas, and hence the ash and char particles, towards the top of the nozzle 14. It further causes a sweeping action of the transition section 26.

Figure 5:
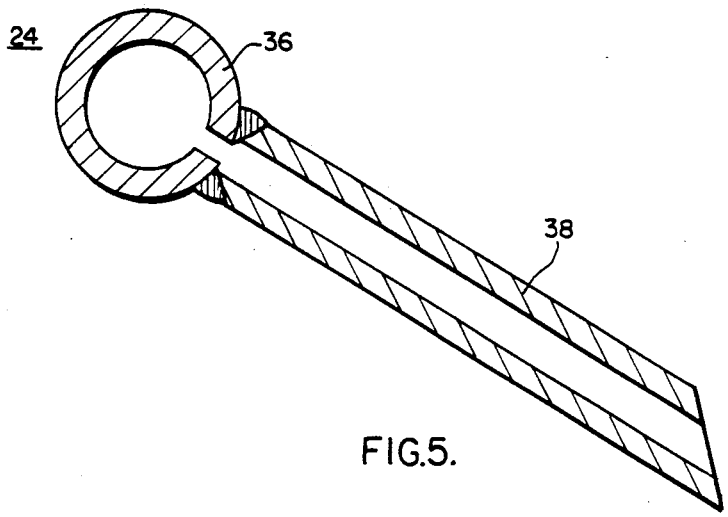
FIG. 5 is an elevational sectional view of a portion of the gas injection grid taken from V—V of FIG. 4.

Looking now at FIG. 5 which is taken from V—V of FIG. 4, the grid 24 can be seen in cross-section showing the grid manifold 36 and a grid inlet 38.

It has been determined that injection of a gas into a fluidized bed will result in the formation of a void, or bubble, in the bed in a manner similar to the injection of a gas into a liquid. It has also been observed that the injection of gas from a number of uniformly distributed horizontal locations in a vertical fluidized bed will break up large bubbles by disruption of the bubble boundary, and thereby minimize perturbations in the overall dynamics of the fluidized bed. Consequently, the grid 24 is disposed uniformly around the ash annulus in such a manner that large bubbles rising from the floor 28 of the vessel 12 will be effected by the gas injected by the grid 24 and thereby broken up.

This system operates in the following manner. Referring now to FIG. 1, various process mediums are injected through nozzle 14 into gasifier vessel 12. A portion of the coal particles combust to provide high temperatures for the process. The remaining particles of coal are heated and fluidized into a bed in the bed region 18. As coal is gasified to leave particles of agglomerated ash, the ash, being more dense, and of larger particle size, than char, gradually defluidizes.

Referring now to FIG. 3, as the agglomerated ash defluidizes into the annulus region 22, rather than falling directly to the floor 28, the ash is defluidized gradually, because the recycled gas, which is injected into the vessel 12 through the floor 28, and the steam, or recycled product gas, which is injected into the vessel 12 through the grid 24 provides a fluidizing force to resist gravity. This flow of fluidizing gas permits gradual defluidization of the heavier, larger ash agglomerates (which descend with a velocity of between 1 and 2 feet per minute), but more vigorously fluidizes the lighter char particles such that they are separated from the heavier ash particles. These separated char particles are transported up from the annulus region 22 into the combustor region 19 and into the bed region 18 where the carbon contained in the char is further consumed. Thus, the fluidization flow serves to both slow the descent of the ash agglomerates and transport char back up to the bed region 18 for further gasification.

The extended time spent in the annulus region 22 defluidizing also provides the ash with the opportunity to cool from the temperature of the fluidized bed. The recycled gas, typically injected at a temperature between 100° and 700° F., and the steam, typically injected at a temperature between 212° and 900° F., cool the ash significantly, from above 1600° F. when it leaves the bed, to a range of 100° to 800° F. when it is discharged. Eventually, the ash passes through the floor 28 and into the ash discharge plenum 32 where it can be further disposed of, such as through large diameter piping and lockhoppers.

Figure 6:
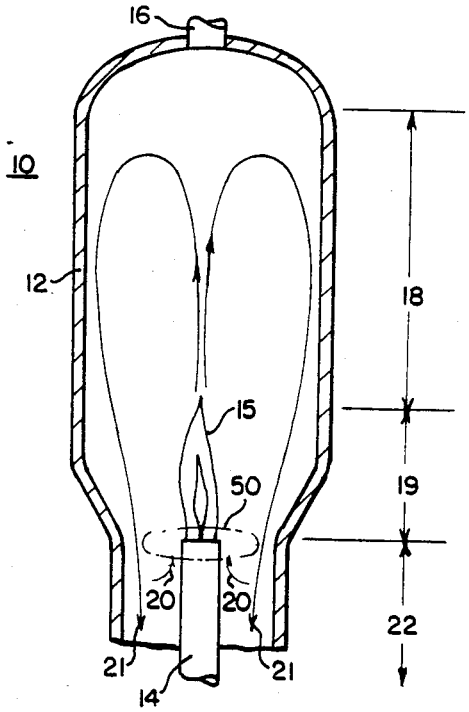
FIG. 6 is an elevational sectional view of a gasification system similar to that of FIG. 1.
Figure 7:
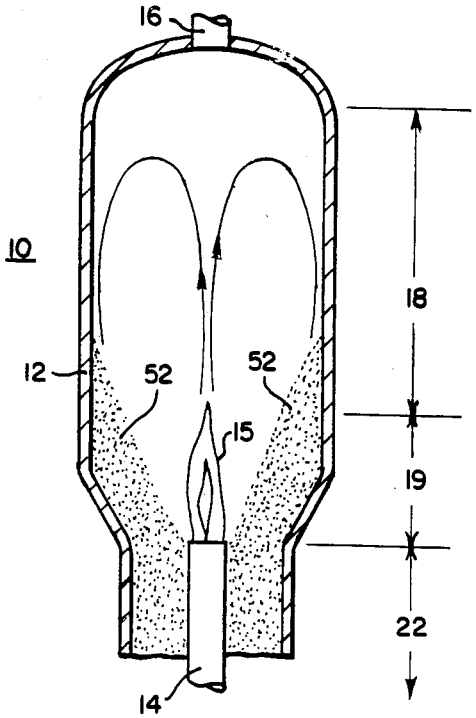
FIG. 7 is an elevational sectional view of a gasification system similar to that shown in FIG. 1.
Figure 8:
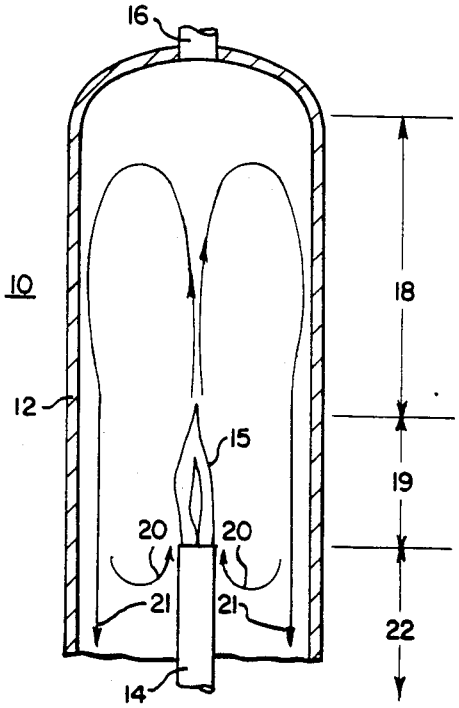
FIG. 8 is an elevational sectional view of a gasification system similar to that shown in FIG. 1.

Looking at FIG. 6 several further advantages of the grid 24 may be seen. Within the gasifier vessel 12 at approximately the elevation of the top of the nozzle 14 and just below the flame 15, there can be seen a low pressure region 50 created by the injection from the nozzle 14 of the process mediums. This low pressure region 50 aids in the fluidization of char back up into the flame 15. As can be seen, both agglomerated ash and char particles flow upward from the flame 15 in the center of the vessel 12 and downwardly along the wall of the vessel 12. Looking now at FIG. 7, it can be seen that the transition section 26 is covered with slag 52. When there is no gas injected from the grid 24, molten particles which are traveling vertically downward along the wall of the vessel 12 will stick to, or slag, the vessel 12 in the transition section 26. In a very short period of time, the slag will build up and eventually form a cone with the nozzle 14 at the center of the cone. If the cone is allowed to continue to build up, it will eventually meet the nozzle 14 preventing any further ash discharge. This problem could be avoided as shown in FIG. 8 by merely extending the upper section of the vessel downwardly to avoid a transition section. The disadvantage of this method is that a char-ash separation function must still be performed to force the differences in particle recirculation paths 20 and 21. If an annulus region 22 has an expanded diameter, it will require a greater quantity of gas to provide the same fluidization velocity in the annulus 22. Referring again to FIG. 3, it can be seen that even though the transition section 26 is steeply slanted there is a possibility that molten particles from the bed will collide and stick to the refractory ceramic 23 in the transition section 26. The downward sweep of the gas from the grid 24 causes the molten particles to be cooled and fluidized such that the particles slide more easily down the transition section 26.

There is a further benefit of the grid 24. By utilizing steam as the grid gas the temperature of the flame 15 and consequently the temperature of the bed region 18 can be reduced, or moderated, without varying the input rates of the various other process mediums. The grid 24 therefore provides for an installed temperature adjustment device.

The grid 24 provides several functions. First, it aids in recycling char back into the combustor region 19. Second, it provides cooling of the agglomerated ash which is defluidizing adjacent the wall of the vessel 12 thus reducing slugging. Third, it provides fluidizing gas in the transition section 26 adjacent the top of the nozzle 14 thus aiding in char-ash separation. Fourth, it provides a mechanism for generating bubbles uniformly across the annulus region 22 to prevent slugging. Fifth, it provides temperature moderation of the flame 15.

It should be noted that the removal of ash from the system 10 after its passage through the annulus 22, and through the ash plenum 32 is typically conducted without the loss from the vessel 12 of a significant quantity of gas. This is generally accomplished through the use of, for instance, lockhopper valves, which are well known in the art, and serve several purposes. First, obviously, is the prevention of loss of valuable product gas. Second, it provides that the general flow of gas in the annulus 22 is upwardly and therefore conducive to the slow defluidization and cooling of agglomerated ash from the bed.

What is claimed is:

1. A method for augmenting internal recirculation of fluidized solids in a fluid bed gasifier wherein product gas, agglomerated ash particles, and char particles are produced, said gasifier having an upper combustion region superimposed on a lower annulus region which comprises:

(a) introducing carbonaceous particles to the gasifier, the gasifier comprising a vertically disposed elongated vessel having an upper section of a first diameter and a lower section of a second diameter and a transition section disposed therebetween;

(b) injecting steam and oxidizing gas axially upward into the combustion region and forming a central low pressure region between the combustion region and the annulus region, circulating said char particles and agglomerated ash particles, and defluidizing said char particles and said agglomerated ash particles downwardly along said transition section;

(c) introducing jets of cooling fluidization gas into said gasifier adjacent said transition section to the combustion region, said cooling gas being introduced and directed radially, inwardly, and downwardly through tubes into said combustion region and toward the central low pressure region and thereby recirculating fluidized solids into the central low pressure region.

* * * * *